United States Patent [19]

Swenson

[11] 4,382,476

[45] May 10, 1983

[54] MANUAL TORQUE MAGNIFYING IMPACT TOOL

[76] Inventor: Oscar J. Swenson, 630 S. Poplar Way, Denver, Colo. 80224

[21] Appl. No.: 327,024

[22] Filed: Dec. 3, 1981

[51] Int. Cl.[3] ..... B25D 15/02

[52] U.S. Cl. ..... 173/93.5; 81/466

[58] Field of Search ..... 173/93, 93.5, 93.6, 173/93.7; 81/465, 466

[56] References Cited

U.S. PATENT DOCUMENTS

| | | | |
|---|---|---|---|
| 2,661,647 | 12/1953 | Swenson | 173/93.5 |
| 2,844,982 | 7/1958 | Swenson | 173/93.5 X |
| 2,954,714 | 10/1960 | Swenson | 173/93.5 |
| 3,108,506 | 10/1963 | Swenson | 173/93.5 |
| 3,156,309 | 11/1964 | Swenson | 173/93 |
| 3,180,185 | 4/1965 | Schmidt et al. | 173/93 |
| 3,184,998 | 5/1965 | Young | 173/93.5 |
| 4,184,552 | 1/1980 | Anderson | 173/93.5 |
| 4,293,044 | 10/1981 | Anderson | 173/93.5 |

*Primary Examiner*—James G. Smith
*Assistant Examiner*—Robert P. Olszewski
*Attorney, Agent, or Firm*—Richard L. Johnston

[57] ABSTRACT

An improved manually operated torque magnifying impact tool is provided having an improved inertia member construction, separate cams for disengaging certain operating members, an improved tool head, improved mechanism for stopping the inertia member, mechanism to limit the decompressive movement of the power spring to absorb the shock associated with such movement, mechanism to utilize the power spring to stop the inertia member resiliently to reduce stress on tool parts, mechanism to accomplish a more uniform input force requirement on the tool head axis, and mechanism to reduce the force of the pawls against the ratchet teeth at the moment of disengagement.

10 Claims, 20 Drawing Figures

FIG. 1
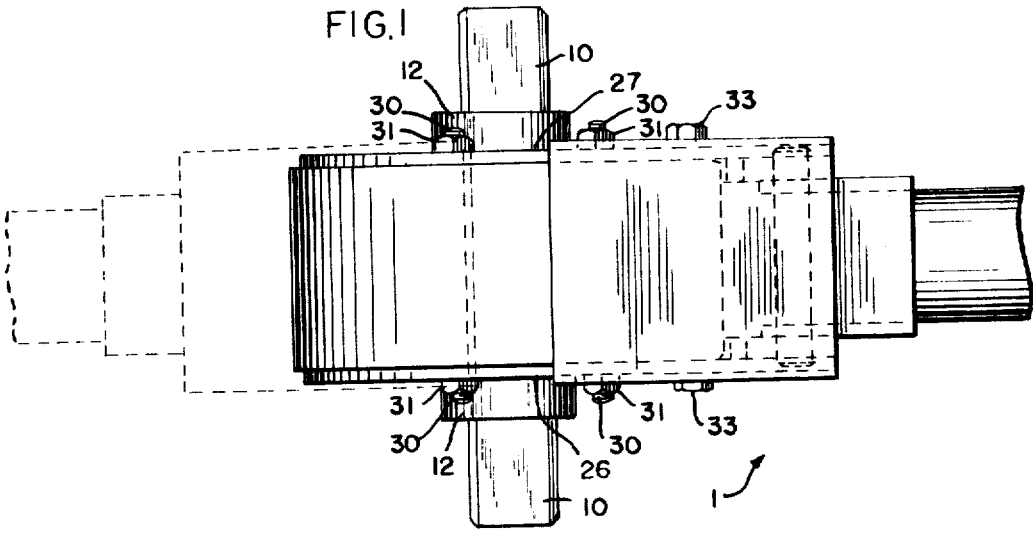
FIG. 2
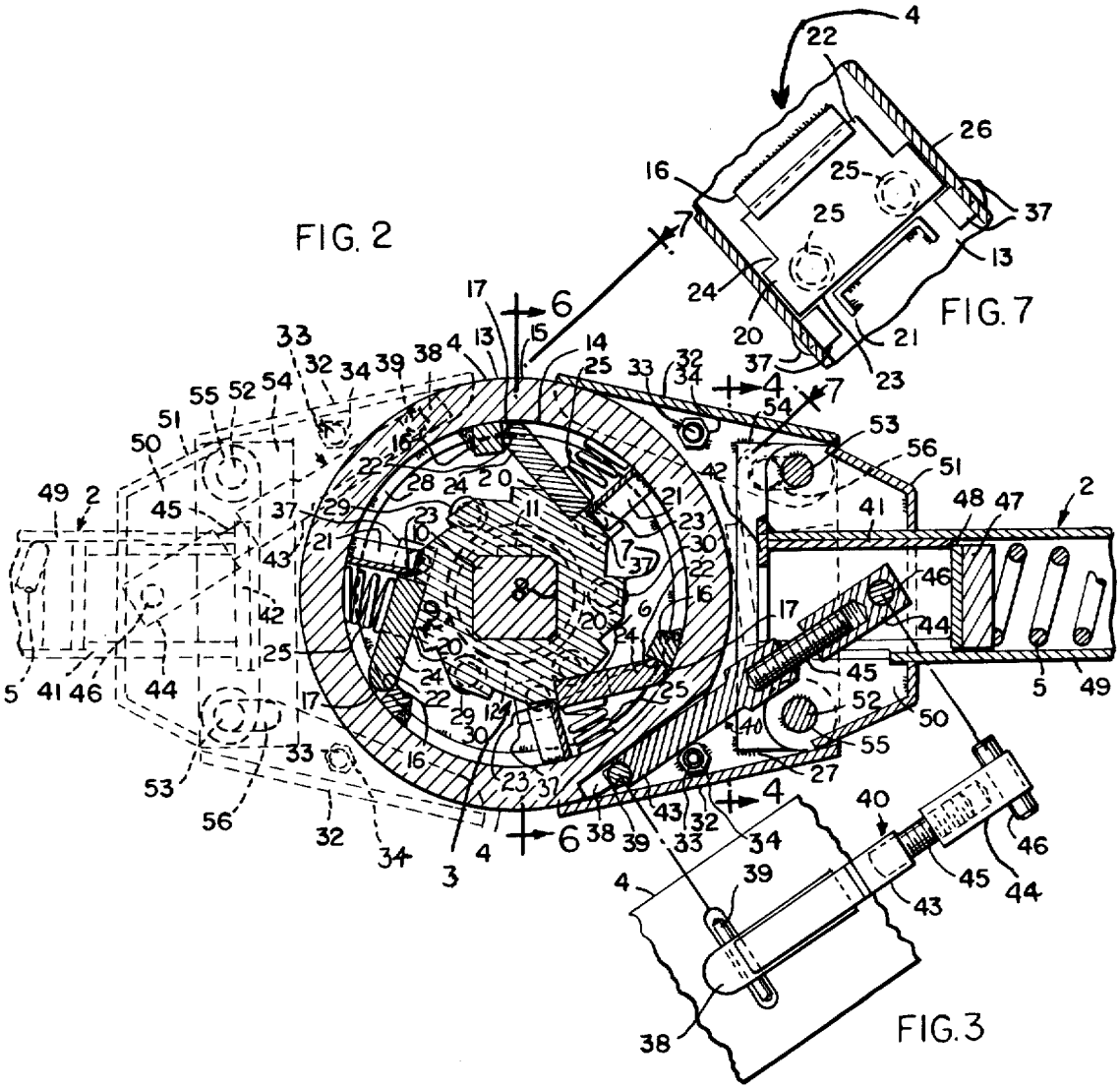
FIG. 7
FIG. 3

FIG. 8
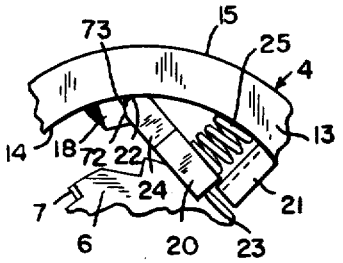
FIG. 17
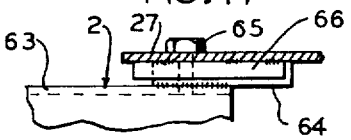
FIG. 10
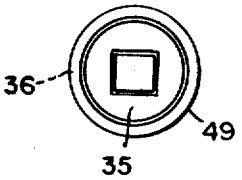
FIG. 9
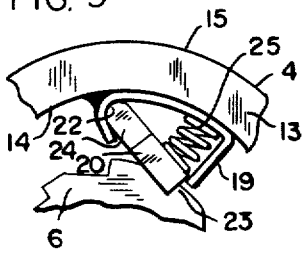
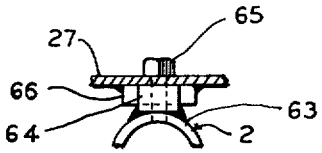
FIG. 18
FIG. 19
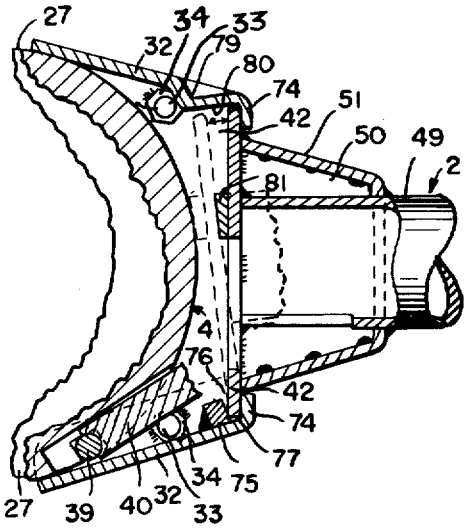
FIG. 20
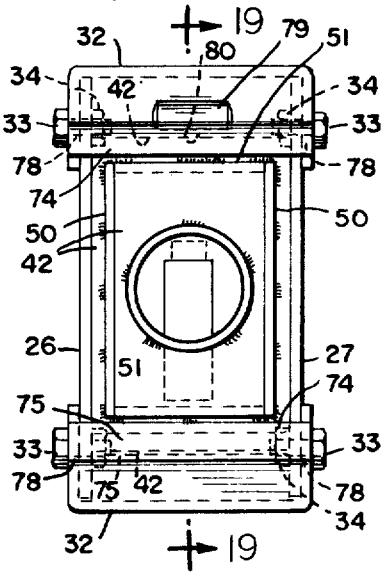

MANUAL TORQUE MAGNIFYING IMPACT TOOL

BACKGROUND

This invention relates to improvements in manually actuated impact tools for applying a torsional force, greater than that applied manually to the tool, to threaded-type fastenings, such as tools of the type shown in U.S. Pat. Nos. 2,661,647, 2,844,982, 3,156,309, and particularly U.S. Pat. Nos. 2,954,714, hereinafter referred to as patent No. 1; and 3,108,506, hereinafter referred to as patent No. 2. Each of these patents, in common with the present application, shows a manually operable impact tool utilizing a manually operable handle, a main power spring, and an annular inertia member carrying pawls which engage a ratchet-toothed member with an output shaft to produce, from energy derived from movement of the handle by torque applied thereto by the operator and stored in and later released by the spring, successive impacts which are delivered as torque through the output shaft to a threaded fastener such as a bolt or nut to tighten or loosen it, when the pawls, disengaged from their respective ratchet teeth on angular movement of the handle relative to the inertia member, engage their respective successive ratchet teeth and release thereto as impact energy the energy stored in the spring and conveyed to the pawls by the inertia member, to result in a magnitude of torque delivered to the output shaft, and through it to the threaded fastener, substantially greater than that of the torque applied to the handle by the operator.

While impact tools constructed in accordance with the disclosures of patents No. 1 and No. 2 have proven superior to those constructed in accordance with the other patents listed above and have found advantageous uses in industry for several years, the experience gained in these uses has disclosed a number of deficiencies in their design and construction. The general objectives of this invention are to eliminate these deficiencies and to provide additional improvements to the former designs and constructions.

BRIEF SUMMARY OF THE INVENTION

The invention provides improvements to manually operated torque magnifying impact tools consisting of an improved inertia member construction affording a larger and continuous bearing surface, reduction in weight, and reduction of cost of manufacture; separate cams for disengaging each pawl to reduce cost of manufacture and maintenance of the tool; an improved tool head with a separable and replaceable drive bar for economy of manufacture and maintenance of the tool, and with a lesser number of teeth on the ratchet for improved performance of the tool and lesser force requirement on the handle to produce a given magnitude of torque output than with the tool of the said patents; improved means for stopping the inertia member including use of the pawls as stop members on the inertia member; addition of a spring stop member to limit the decompressive movement of the power spring and to absorb the shock associated with such movement; use of the power spring also as a recoil spring to stop the inertia member resiliently to reduce stress on tool parts; means to accomplish a more uniform input force requirement on the tool handle throughout its range of angular movement about the tool head axis; and means to reduce the force of the pawls against the ratchet teeth at the moment of disengagement.

DETAILED DESCRIPTION OF THE INVENTION

The best mode contemplated for the practice of the invention is illustrated in the drawings and the accompanying description wherein:

FIG. 1 is a plan view illustrating a manually operated torque magnifying impact tool constituting the best mode contemplated for the practice of the invention;

FIG. 2 is a cross sectional view taken vertically through bar 10 of FIG. 1;

FIG. 3 is a detailed view of a portion of the device shown in FIG. 1;

FIG. 7 is a detailed cross sectional view taken along the line 7—7 of FIG. 2;

FIGS. 8, 9 and 10 are detailed views of alternative structures of the device shown in FIG. 2;

FIGS. 11 to 18 illustrate an alternative construction having a double handle wherein FIG. 11 is a plan view;

FIG. 12 is an elevational view with parts broken away;

FIG. 13 is a view with enclosure plate 71 removed;

FIG. 14 is a sectional view taken along the line 14—14 of FIG. 12;

FIG. 15 is a sectional view taken along the line 15—15 of FIG. 12 with a spring 5 not shown;

FIG. 16 is a sectional view taken along the line 16—16 of FIG. 12;

FIG. 17 is a sectional view of a portion of FIG. 12;

FIG. 18 is a sectional view of a portion of FIG. 12;

FIG. 19 is a partial side sectional view of an alternative construction with a pivoted handle with cross slide 41 and spring 5, not shown, and FIG. 20 is an end view of FIG. 19. FIG. 19 can also be described as a vertical sectional view taken through the center of FIG. 20.

Figure 4:
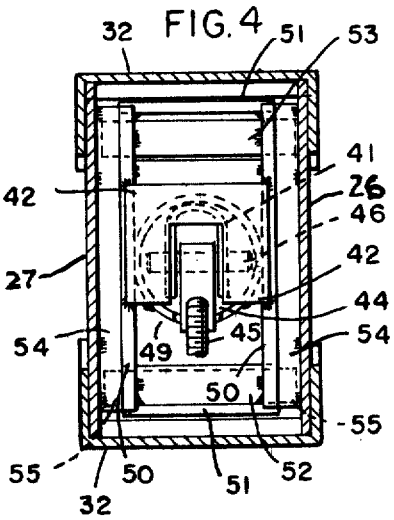
FIG. 4 is a cross sectional view taken along the line 4—4 of FIG. 2.
Figure 5:
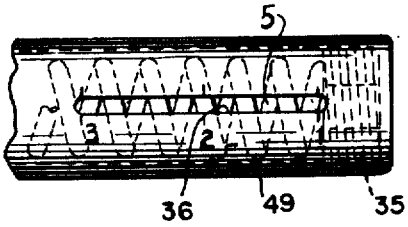
FIG. 5 is another detailed view of a portion of the device shown in FIG. 2.

Referring to FIGS. 1 through 10, and substantially in common with the torque magnifying tools of the said patents, and particularly with the tools of the said Patents Nos. 1 and 2, the tool or tool assemblies of this invention comprise essentially a tool head 3 having a ratchet portion 6 with ratchet teeth 7 and a drive bar portion 10 extending axially on each end of the ratchet portion; an annular inertia member 4 surrounding the ratchet portion 6 on a common axis therewith; frame members 26 and 27 transverse the said axis at each end of the inertia member 4, respectively, and joined by cross members 32, cap screws 33 and nuts 34; a handle assembly 2 attached to each of frame members 26 and 27 extending perpendicularly to said axis; bearing means 28 and 12 attached to each of frame members 26 and 27 supporting inertia member 4 and ratchet portion 6, respectively, guiding the tool head 3, inertia member 4, frame members 26 and 27 and handle 2, for angular rotation relative to each other about said axis; a power compression spring 5 within handle 2 operatingly connected to the inertia member 4 to enable storing energy in and releasing energy from spring 5 on angular movement of handle 2 relative to inertia member 4, and on angular movement of inertia member 4 relative to handle 2, respectively; a spring adjusting nut 35 and spring adjusting gauge 36 on handle 2 for setting desired initial compression of spring 5; pawls 20 equally spaced about said axis and supported movably on the inertia member 4 and biased by springs 25 for engagement with and disengagement from ratchet teeth 7; stop means on frame members 26 and 27 cooperating with stop means on inertia member 4 to limit angular rotation of inertia member 4 relative to handle 2 in one direction about said axis; and a cam 29, one for each pawl, attached to frame members 26 and 27 and operable against the pawls 20 on angular movement of handle 2 about said axis relative to inertia member 4 and tool head 3 in a predetermined direction to enable disengagement of the pawls 20 from the ratchet teeth 7, subsequent rotation of the inertia member 4 about said axis in said predetermined direction relative to ratchet portion 6, and reengagement of pawls 20 with the respective successive ratchet teeth 7, to impart thereto as impact, energy released from spring 5.

In accordance with the description in the preceding paragraph and by reference to said Figures, and assuming that the tool head 3 is held rotationally immobile by the drive bar being suitably connected, as with a commonly used socket, to a threaded fastener being serviced by the tool, it will be apparent that continuous angular movement of the handle 2 in a clockwise direction about the said axis relative to the ratchet 6 and inertia member 4 will result in successive cycles of disengagement of the pawls 20 from the ratchet teeth 7 by the cams 29 and reengagement of the pawls 20 with the ratchet teeth 7 with impact force to produce torque on the ratchet 6 and drive bar 10, and therefrom torque to the fastener being serviced, the magnitude of the torque so delivered being greater than that of the torque applied to the handle by an operator. The theoretical degree of magnification of the torque value applied to the handle with respect to that delivered to the fastener being serviced is a function of the ratio that the magnitude of the angular movement of the handle bears to the corresponding angular movement of the drive bar resulting from the impacts of the pawls against the ratchet teeth. Thus, theoretically, if the drive bar were held completely immobile and the tool parts were non-elastic and movable without friction, the value of the output torque would be infinite. Under the practical conditions prevailing in an actual tool as described above, however, the output torque is limited to a maximum of about twenty times the input torque at the handle.

From the maimum output torque value attained by the tool against an immobile fastener being serviced, this torque value decreases inversely with the angular movement of the engaged fastener with each applied impact, as would be the case in loosening a nut on a bolt. Conversely, when tightening a fastener, the output torque from the tool increases with each successive impact as the movement of the fastener per impact decreases. In either the loosening or tightening operation, the torque required to move the handle remains substantially constant.

CONSTRUCTION OF INERTIA MEMBER

An important objective of this invention is to provide an improved inertia member construction for more economical manufacture and of lesser weight than that of the said patents.

In all of these patents, except in patent No. 2, the inertia member design requires that the pawl recesses and pawl seats therein be machined in the solid metal of the inertia member at considerable cost. It is attempted in patent No. 2 to improve on this design by providing that the inertia member be constructed of powdered metal pressed into an appropriate mold and subsequently sintered in a furnace to produce a substantially homogeneous structure. The product of this procedure proved satisfactory only for the smaller sizes of tools because of the economically intolerable cost of the molds, and the need for manufacture of the tools in undesirably large volume to distribute this cost. Patent No. 2 also suggests that the inertia member be built up of laminates stamped from sheet metal or metal plate with the required pawl recesses and seats incorporated in the stamp configuration. This method is not completely satisfactory because the rivets used to join the laminates become loose as a result of repeated impacts on use of the tool, or by cracking of welds used as an alternative to the rivets to join the laminates.

To overcome the above described disadvantages of the inertia member construction of the same patents, this invention provides a unique inertia member construction using as its basic structure a piece of steel tube 13, of length equal to the desired width of the inertia member, cut from standard commercially available steel tube stock. The curved edge 22 of the pawl 20 is seated in the pawl seat 17 formed by an abutment 16 welded or otherwise attached to the inner surface 14 of the tube 13 and by the adjacent tube surface 14. A retaining member 21 is welded to the inner surface 14 of the tube 13 to loosely engage the unseated edge 23 of the pawl 20 to hold the pawl pivotally in the seat 17. Patent No. 2 provides an arcuate surface in the pawl recess to serve this same purpose of holding the pawl in its seat, but it has been found that the straight retainer 21 serves equally as well and is more economical to manufacture. The pawl springs 25 are placed between the pawl and the inner surface 14 of the tube 13, with no requirement for machine work to form the pawl recess as required by the design of said patents.

An alternative configuration for the pawl seat 17 is indicated in FIG. 8 wherein the abutment 18 has a curved recess 72, preferably formed thereon prior to its attachment to the inertia member 4, to match the curved edge 22 of pawl 20, which recess, together with inner surface 14, forms the alternative pawl seat 73.

Another alternative configuration for construction of the pawl seat 17 and pawl retainer member 21 shown in FIG. 9, consists of a preformed pawl cage 19, combining the functions of pawl seat 17 and pawl retainer member 21, welded or otherwise suitably attached to tube 13. Various alternative constructions to serve the function of pawl seat 17 and pawl retainer 21 are readily apparent, so the constructions indicated by this invention are not limited to those described and shown.

Figure 12:
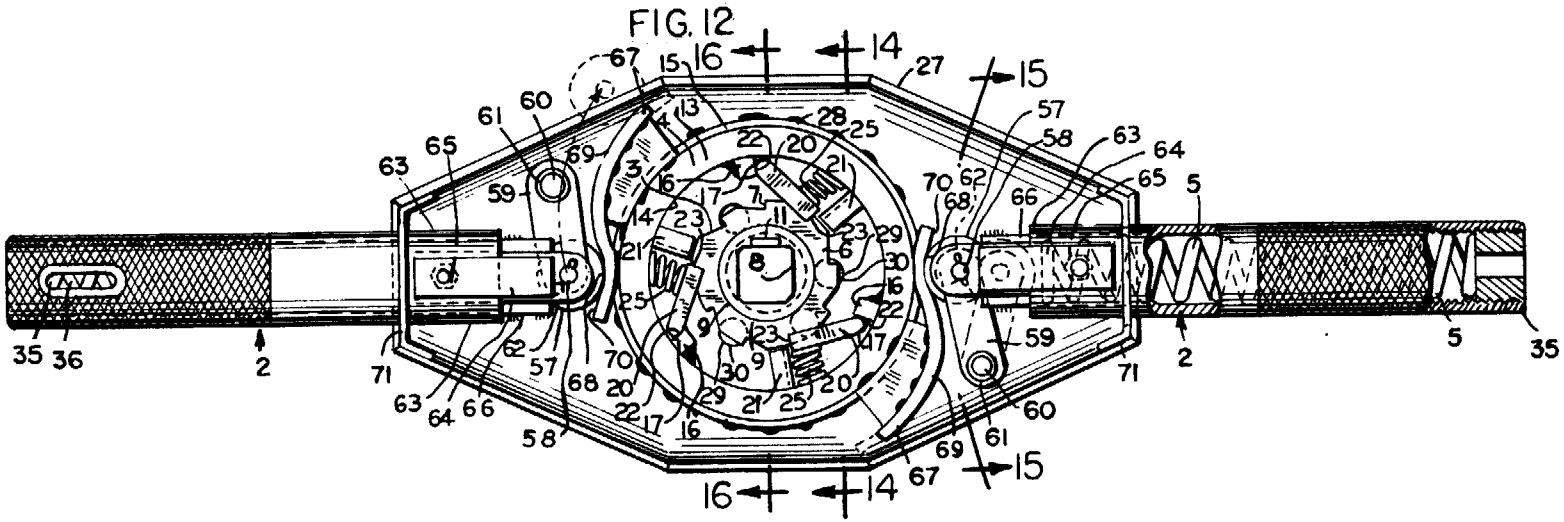
Figure 13:
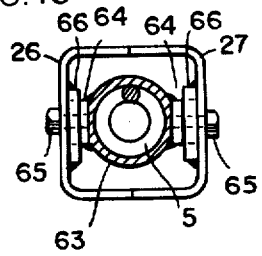
Figure 14:
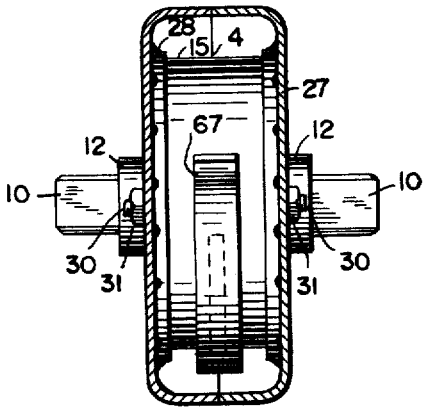
Figure 15:
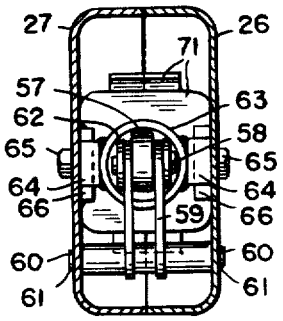
Figure 16:
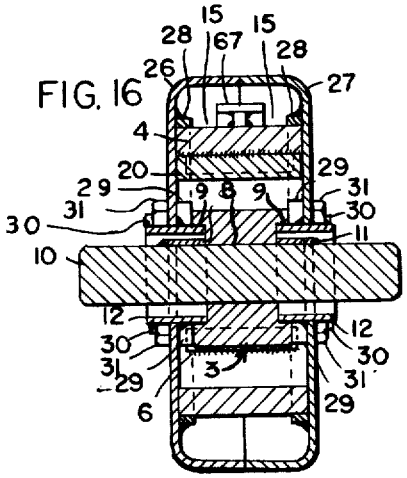

Another important improvement in the construction of the inertia member 4 provided by this invention is the use of either the inner surface 14 or the outer surface 15 of the tube 13, with little if any machine work required to serve as a large continuous bearing surface for the inertia member 4, in contrast to the smaller machined bearing surface, interrupted by the pawl recesses, of patents No. 1 and No. 2, to correspondingly reduce the unit bearing load on the bearing surface. As shown in FIG. 2, inner surface 14 mates as a bearing with bearing member 28 attached to each of frame members 26 and 27. Alternatively, as shown in FIG. 12 outer surface 15 mates as a bearing with bearing member 28. When inner surface 14 of tube 13 is used as a bearing surface as in FIG. 2, pawl 20 has a notch 24 at each end of the pawl to provide operating clearance with bearing member 28. When outer surface 15 is used as a bearing surface as in FIG. 12, notch 24 is not needed. If desired, balls or cylindrical rollers may be placed between bearing surfaces 14 or 15 and bearing member 28 to reduce bearing friction.

To complete the construction of inertia member 4, slot 38 and pitman pin 39 are provided. Alternatively, an inertia member cam 67 is attached to the outer periphery of tube 13 as shown in FIG. 12 and described later herein.

CAMS FOR DISENGAGING PAWLS

The pawl disengaging cam of the said patents consists of an integral member attached to the tool frame opposite the ends of the inertia member. This integral member includes a cam surface for each pawl, an interrupted bearing surface which mates with an inner bearing surface of the inertia member, and an inner bering surface supporting the integral round shaft extension of the tool head. This construction has several disadvantages, namely, it is expensive to manufacture, it provides an inadequate interrupted bearing surface to support the inertia member, and it is difficult to attach to the tool frame to prevent it from breaking loose as a result of shock load from the tool impacts.

Figure 6:
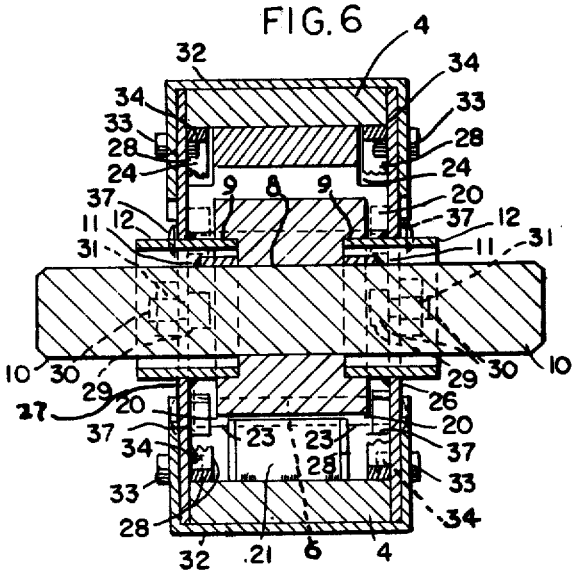
FIG. 6 is a cross sectional view taken along the line 6—6 of FIG. 2.
Figure 11:
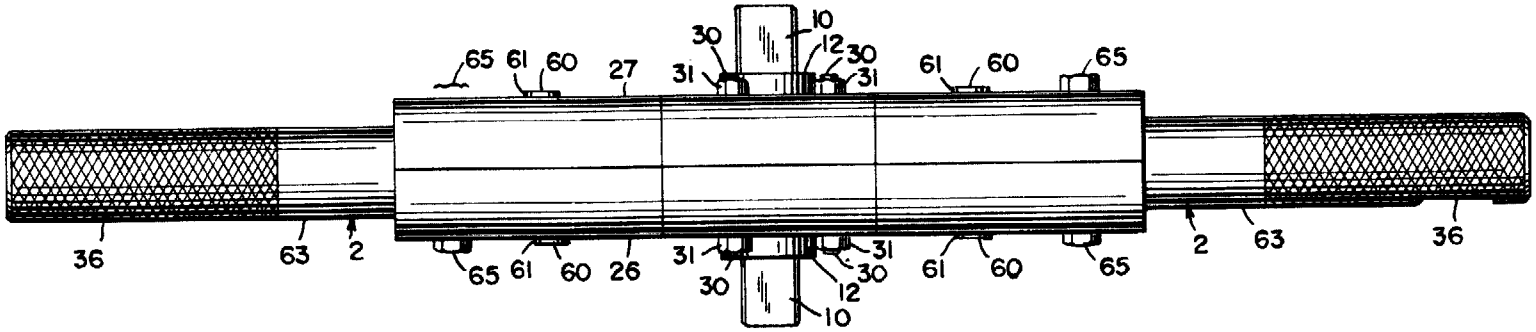

The improved pawl disengaging means of this invention consists of a separate cam for each pawl, such a cam 29 for each pawl being attached to frame member 26 and such a cam 29 for each pawl being attached to frame member 27. These cam units 29 carry only the load of disengaging the pawls, so thus are not subjected to any shock load resulting from the tool impacts as is the case with the combination cam and bearing design of the said patents. As shown in FIG. 6, the cam 29 consists of a standard round head cap screw 30 whose shank passes through frame member 26 or 27 on which the particular cam is mounted and is secured on the opposite side by nut 31. Alternatively, rivets could be used with their heads serving as the cam surfaces and the shanks clinched on the opposite side of the frame plate in lieu of a nut, but the cap screw and nut is preferred because of the ease of assembly and of replacement in case of excessive wear with use of the tool.

TOOL HEAD CONSTRUCTION

The tool head of the said patents is an integral unit comprising a cylindrical portion with ratchet teeth on its periphery parallel to the axis of the cylinder, a round shaft extension axially at each end of the cylindrical portion, and a square shaft extending axially beyond the round shaft extension to engage the square opening of a standard socket for driving a nut or bolt head. Construction of the integral unit from solid steel stock reuires expensively machining away a substantial portion of the rough stock and also wasting a large amount of costly alloy steel. Furthermore, since the square extension is vulnerable to breakage, being the weakest part of the unit, this breakage requires replacement of the entire expensive integral unit.

To overcome the above described disadvantages of the tool head of the said patents, this invention provides a tool head 3 with square drive bar 10 which is separable from a cylindrical ratchet portion 6. The ratchet portion 6 can be made from a short section of standard round steel bar with a minimum of machine work. A square opening 8 is cut axially through the ratchet portion 6 through which square drive bar 10, cut from standard square steel stock, is passed and held in place longitudinally by retaining tabs 11 welded to the bar 10 adjacent each end of the ratchet portion 6. Prior to installing square drive bar 10, a bearing surface 9 is machined at each end of the ratchet portion 6 and ratchet teeth 7 cut in its peripheral surface. Alternatively, opening 8 and drive bar 10 could be splined.

The cylindrical ratchet portion 6 is supported for rotation about said axis by engagement of the bearing surface 9 with the surface of a tube member 12 attached to each of frame members 26 and 27, respectively. The tube member 12 is of such inner diameter so as to allow square drive bar 10 to pass therethrough without contact with the tube member 12.

The said patents provide for a ratchet with twelve teeth, resulting in thirty degrees of continuous angular handle movement between successive impacts by the tool, or thirty degrees, plus about seven degrees arbitrarily allowed for angular rotation of the inertia member and tool head following an impact on initial movement of the handle. Experimental results and design considerations have indicated that a handle movement greater than 30 degrees is desirable to reduce the force required to move the handle manually to produce a given output torque value, and in the case of the pitman actuated spring design, to enable more effectively compensating for the increasing force of the power spring as it is compressed to accomplish as uniform force requirement on the handle as possible throughout the range of its angular movement, and to enable desirably minimizing the force of the pawls against the ratchet teeth at the movement of disengagement of the pawls from the ratchet teeth. This invention therefore provides for a ratchet with nine teeth instead of twelve as in the said patents, and experimental and use results confirm the anticipated advantages of the lesser number of ratchet teeth. Use of a ratchet with nine teeth results in forty degrees of continuous angular movement of the tool handle between impacts by the tool. With an arbitrary allowance of about ten degrees in the design for angular rotation of the inertia member and tool head, about fifty degrees of handle movement is required for an initial impact.

Means for Compressing Spring and Stopping Inertia Member

It has been found through use experience that many of the problems associated with the designs and constructions of the tools of the said patents are related to the problem of stopping the inertia member by absorbing the kinetic energy of rotation therefrom in those instances where all of this energy is not absorbed by impact of the pawls against the tool head, such as would be the case sometimes with the final impacts when loosening a fastener or with the initial impacts when tightening a fastener. The differences in the constructions of this invention from the constructions of the said patents to eliminate the said problems are described below.

In the tool of patent No. 1, the coupling between the inertia member and the power spring includes a pitman and cross slide operable reciprocatingly in the handle to compress and decompress the spring.

In this invention the coupling means between the inertia member 4 and the cross slide 41, operable reciprocatingly in handle tube 49, to compress and decompress spring 5 on angular movement of handle 2 relative to the inertia member 4 about the axis of the inertia member in a clockwise direction, in reference to FIG. 2, or decompression of the spring on clockwise rotation of the inertia member relative to handle 2, consists of a pitman assembly 40. As depicted in FIG. 2, pitman assembly 40 comprises pitman pin 39 attached to inertia member 4, pitman pin bearing member 43, cross slide pin 46, cross slide pin support 44, and pitman adjusting screw 45 to enable adjustment of the distance between pin 39 and pin 46. Inclusion of such adjustment means in pitman assembly 40, or alternatives thereto to serve the same purpose is desirable but not mandatory for the satisfactory operation of the tool, as will be described later herein.

The tools of patent Nos. 1 and 2 include a single stop member on the periphery of the inertia member which sometimes engages a stop member on the tool frame to stop rotation of the inertia member or to hold it rotationally immobile relative to the handle when the tool is at rest or when the handle is moved angularly in a counterclockwise direction about the axis of the tool head to result in resilient movement of the pawls over the ratchet teeth in a manner similar to that in a conventional ratchet wrench. Forcible engagement between the said stop members which often occurs in operation of the tools results in the imposition of a heavy shock load on the bearings supporting the inertia member which is also offset from the bearing axis which is a highly undesirable condition for the durability of the tools.

This invention provides stop means on the inertia member and on the tool frame which not only serve the same purpose as the steps in patents Nos. 1 and 2, but which also eliminate the disadvantages associated with these stops described above for the tools of patents Nos. 1 and 2. These improved stop means include more than one stop member on the inertia member equally spaced about its axis, each such stop mating with a stop member attached to the frame member of the tool. One such arrangement is depicted in FIGS. 2 and 6 in which the ends of the pawls 20 extending between the ratchet 6 and the frame members 26 and 27 engage as stop members on the inertia member 4 with stop members 37, one stop 37 for each pawl, attached to each of frame members 26 and 27. Since these mating stop members are symmetrically arranged around the axis of the inertia member, their engagement imposes no load on the bearings 28 supporting the inertia member 4.

Use of the ends of pawls 20 as stops on the inertia member 4 requires that provision be made to prevent pressure of spring 5 against the inertia member 4 from forcing the pawls 20 against stops 37, which condition would preclude said resilient movement of the pawls over the ratchet teeth when handle 2 is moved in counterclockwise direction about the tool head 3. Said provision consists of cross slide stop member 42 attached to the end of handle tube 49 adjacent inertia member 4. Stop member 42 carries the initial force of spring 5 of magnitude determined by the chosen position of spring adjusting nut 35, and also stops decompressive movement of the spring 5 short of causing the pawls 20 to contact stops 37 forcibly. The open end bearing at the end of pitman 40 which engages pin 39 on the inertia member 4 permits maintenance of a practical clearance between said bearing and pin 39 to insure against said forcible contact between pawls 20 and stops 37 by force from spring 5. To minimize the need for extraordinary precision in manufacture of the tool parts to achieve said clearance and to facilitate adjustment of this clearance during assembly of the tool and thereafter as a maintenance procedure for the tool, FIG. 2 shows pitman assembly 40 including means for adjusting the distance between pin 39 and pin 46 as described earlier herein to readily provide said clearance at the desired value. Other means to adjust said clearance easily as may be required are readily apparent, and as stated earlier these adjusting means are not mandatory since the tool can be manufactured to operate satisfactorily without inclusion of the said adjusting means. Stop member 42 also serves an additional advantageous function by absorbing energy associated with stopping spring 5 following an impact of the tool in which all of the kinetic energy of rotation of the inertia member was not absorbed as impact on the tool head, thus relieving pitman 40 of the stresses associated with such an occurrence. To cushion the shock on forcible engagement of cross slide 41 with stop member 42 on sudden stopping of spring 5, a resilient cushion member 47 and back up plate 48 are provided between spring 5 and cross slide 41.

In stopping the inertia member of all of the tools of the said patents, considerable force is developed between the stop member on the inertia member and the stop member on the tool frame. Movement of these frame members to relieve this force is resisted by their inertia, and to a much greater degree by the inertia of the attached handle whose inertial resistance increases exponentially with the length of the handle. Thus the relatively short handles on the smaller tools offer relatively little inertial resistance, so the hand of the operator on the handle proves to be an adequate shock absorber in stopping the inertia member. As the size of the tool is increased with correspondingly longer handles, however, some means for absorbing shock between the inertia member and the handle is necessary to avoid excessive stress on the tool parts while stopping the inertia member. In this connection, patent No. 1 provides a resilient gasket between the tool frame and the handle which has proven to be only partially satisfactory in use, particularly in the larger sizes of tools. Patent No. 2 provides for one of the stop members to include shock absorbing means. As stated in patent No. 2, however, the design shown is intended "for light duty wrenching service," hardly a recommendation for use of this design of larger tools.

To overcome the above described problems associated with stopping the inertia member, this invention provides for use of the power spring 5 to serve in the dual function of power spring to store and relase energy for impacts, and of recoil spring between the inertia member and the handle to absorb kinetic energy of rotation from the inertia member not delivered to the tool head, and thus to contribute to bringing the inertia member to a resilient stop without imposing excessive stresses on any of the tool parts.

One means of using the spring 5 to serve in the dual function of power spring and of recoil spring, in combination with pitman 40, cross slide 41, pawls 20, and stops 37, is shown in the tool of FIG. 2 in which the handle 2 is joined to the frame members 26 and 27 in a manner to allow limited counterclockwise rotation of the handle on handle pivot pin 52, resulting in partial compression of spring 5. Pivot pin 52 is attached to handle flanges 50 and is operable pivotally in bearing 55 on support member 54 attached to each of frame members 26 and 27. Handle stop pin 53 is attached to handle flanges 50 which are joined to handle tube 49 by cross slide stop 42 and handle flange cover 51, said stop pin 53 is operable reciprocatingly in stop slot 56 on support members 54 to limit the range of said counterclockwise rotation of handle 2 on pin 52 after forcible engagement of pawls 20 with stops 37 subsequent to an impact of the tool in which all of the kinetic energy of rotation of the inertia member 4 was not absorbed as impact on tool head 3. Following said forcible engagement of pawls 20 and stops 37, inertia member 4 and frame members 26 and 27 rotate as a unit substantially about the axis of the inertia member causing handle 2, because of its inertial resistance to movement along with the inertia member and frame members, to rotate counterclockwise on pin 52, resulting in partial compression of spring 5, as stated above, thus absorbing energy not delivered by the inertia member to the tool head 3 and contributing to stopping the inertia member without excessive stresses on the tool parts.

An alternative construction to that described in the immediately preceding paragraph to join handle 2 to frame members 26 and 27 to allow said limited counterclockwise rotation of the handle 2 relative to frame members 26 and 27 about a pivot to cause partial compression of spring 5 is shown in FIG. 19 and FIG. 20. In this construction cross slide stop 42 on handle tube 49 is extended perpendicularly to handle tube 49 to rest against an abutment 74 on each of crossmembers 32 to carry the thrust of spring 5 when the tool is at rest. The cross member 32 adjacent pitman pin 39 carriers an abutment 75 parallel to and spaced from the adjacent abutment 74 to form a notch 76 into which the edge 77 of cross slide stop 42 is seated loosely to allow it to pivot on edge 77 as a bearing to provide for said limited counterclockwise rotation of handle 2 in a manner similar to that previously described for said rotation on pivot pin 52, to cause partial compression of spring 5. Guide surface 80, of indentation 79 on the cross member 32 not carrying abutment 75, contacts the edge of cross slide 42 to hold the opposite edge 77 thereof operably in notch 76. The range of said counterclockwise rotation of handle 2 about edge 77 relative to frame members 26 and 27 is limited by contact of stop 81 on cross slide stop 42 with inertia member 4 and by contact with abutment 74 on cross member 32 adjacent pitman pin 39. Clockwise rotation of handle 2 about edge 77 relative to frame members 26 and 27 is limited by contact of cross slide stop 42 with abutment 75 and with abutment 74 on the cross member 32 which does not carry abutment 75. Slight longitudinal elongation of the holes 78 in cross members 32 for cap screws 33 will enable adjustment of the positional relationship between cross slide stop 42 and clearance between pawls 20 and their relative stops 37 as an alternative procedure for making said adjustment previously described involving the adjustable feature of pitman assembly 40.

Construction of the pivotal handle connection is not limited to those described herein, since other suitable constructions to provide the functions described are readily apparent.

Cam-Actuated Spring

FIGS. 11 through 18 show another configuration of a tool using the spring 5 to serve both as a power spring and as a recoil spring in which two opposing handles 2, each enclosing a spring 5, with a handle boss 64 on each side of the handle tube 63 at one end and each boss seated in handle boss seat 66 on frame members 26 and 27 and secured to said frame members by cap screws 65 to fix handle 2 rigidly to frame members 26 and 27 with end closure plate 71 closing the space between handle and frame members, and in which pitman 40 and cross slide 41 of the tool of FIGS. 1 through 10 are replaced by means for compressing and decompressing spring 5 comprising an inertia member cam 67 attached to and extending circumferentially partially around and radially outward from the peripheral surface of inertia member 4, which cam includes a detent portion 68 with a power portion 69 and a recoil portion 70 circumferentially on opposite sides of detent portion 68, and a cam follower roller 57 mounted for rotation on roller pin 58 on support member 59 carried on a pivot pin 60 operable in bearing 61 on each of frame members 26 and 27, with support member 59 connected for operational contact with spring 5 by clevis 62.

During operation of the tool, pressure of spring 5 seats roller 57 in detent portion 68 and thus holds the handles 2 and inertia member 4 rotationally immobile relative to one another when the handles 2 are not being moved clockwise about the tool head. When the tool head 3 is held rotationally immobile such as by engagement of drive bar 10 with a fastener being serviced, movement of the handles 2 clockwise about the axis of the tool head 10 causes the roller 57 to move over the power portion 69 to compress springs 5. On such movement of the handles 2 of about fifty degrees, the pawl cams 29 disengage the pawls 20 from the ratchet teeth 7, whereupon the roller 57 recedes along power portion 69 toward the detent portion 68, meanwhile decompressing springs 5 and impelling the inertia member 4 to the position of reengagement of the pawls 20 with the respective successive ratchet teeth 7 to produce impact on the tool head 3.

With nine ratchet teeth on the tool head 3, there is a continuous angular handle movement of forty degrees required between successive impacts on the tool head if the tool head does not rotate. An arbitrary practical value of about fifty degrees of required angular clockwise handle movement relative to the inertia member and the tool head is provided from the rest position of the handles 2 with the roller 57 seated in the detent portion 68 to the position of the handles on disengagement of the pawls 20, to allow for an angular movement of the tool head and the fastener engaged as a result of an impact of about ten degrees before the roller 57 recedes sufficiently to be again seated in the detent portion 68. Should an impact on the tool head not absorb all of the kinetic energy of rotation from the inertia member 4, the inertia member and tool head will continue to rotate in a clockwise direction relative to handles 2 and cause the roller 57 to pass the detent portion 68 and move along the recoil portion 70 to partially compress springs 5 and thus absorb kinetic energy of rotation from the inertia member 4 not expended against the tool head 3 to contribute to bringing the inertia member 4 to a resilient stop, whereupon the roller 57 recedes to its rest position in detent portion 68.

The cam-actuated spring compression means of the tool of FIGS. 11 through 18 has important advantages over the pitman-actuated spring compression means of the tool of FIGS. 1-10, namely, that the cam follower roller 57 operates with considerably less friction loss than does the cross slide 41, the inertia member 4 is stopped with less shock than that associated with the engagement of stop members 20 with stop members 37, and the contour of the power portion 69 of the inertia member cam 67 can be shaped so as to more adequately compensate for increasing pressure of the spring 5 during its compression to accomplish more uniform force requirement on the handle over its range of movement, and to reduce the force of the pawls on the ratchet teeth at the moment of their disengagement from the ratchet teeth to a lower value, than is possible with the pitman-actuated spring compression means of the tool of FIGS. 1-10.

Comparison of Single and Double Handle Tools

FIGS. 1-10 show a single handle tool with a pitman 40 and cross slide 41 coupling the inertia member 4 with spring 5, as indicated by the solid lines at the right side of the drawing, and a double handle tool created by addition of a second handle as indicated by combining the dotted lines at the left side of the drawing with the solid lines at the right side of the drawing. FIGS. 11-18 indicate a double handle tool in which the coupling means between the inertia member 4 and the springs 5 includes an inertia member cam 67 to actuate the springs 5, instead of pitman 40 and cross slide 41 as shown in the tool of FIGS. 1-10.

Where space limitations associated with a particular application do not preclude its use, the double handle tool is generally advantageous over the single handle tool because pure torque is applied to the handles by the operator, which is particularly desirable when using a drive extension between the tool and the work being serviced, and because, in contrast to the single handle tool, the force of the opposing springs against the inertia member is balanced, thereby minimizing the load on the inertia member bearings and the friction associated therewith, resulting in more efficient conversion of input torque to output torque than with the single handle tool. This reduced friction on the inertia member bearing has a further advantage for the double handle tool in that it permits providing for disengagement of the pawls at an angular position of the inertia member relative to the direction of force of the spring against this member which is closer in this respect to the dead center position of the inertia member without its locking to preclude decompression of the spring on such disengagement than is possible with the single handle tool with higher inertia bearing friction. Thus the force of the pawls against the ratchet teeth at the moment of disengagement can be desirably minimized in the double handle tool, since this force approaches zero as the said angular position of the inertia member approaches zero.

The cam-actuated spring design of FIGS. 11-18 is not well suited for a single handle tool because space limitations for the inertia member cam dictate use of a relatively short stroke for compression of the springs 5, which in turn requires high spring pressures against the inertia member to obtain the required amount of energy storage in the springs, with correspondingly high unbalanced load on the inertia member bearings in a single handle tool. Since the spring pressure on the inertia member by the opposing springs is balanced in the double handle tool, the high spring pressure associated with the cam-actuated spring design is not a significant detriment in the double handle tool design. The longer stroke for compression of the springs 5 in the design of FIG. 1 using pitman 40 and cross slide 41 for spring compression, and the associated lower unbalanced spring pressure against the inertia member bearings required to develop the amount of energy storage desired in the spring, renders this design suitable for construction in either the single handle or double handle configuration.

Comparison of Performance of Manual Impact Tools

Comparative performance tests indicate a weight reduction of over fifteen percent and a reduction in manual force requirement on the input handle of the tool of over twenty percent, for the same magnitude of torque output, for the tools constructed according to this invention, as compared to tools constructed in accordance with the said patents.

The invention is hereby claimed as follows:

1. A manually operable torque magnifying impact tool comprising a rotary tool head, an annular inertia member around the tool head on a common axis therewith, a frame member transverse to the common axis at each end of said inertia member, a torque input handle extending transversely of said axis and connected to said frame member, an elongated power spring within said handle, coupling means between said power spring and said inertia member providing for storing and releasing energy, bearing means coaxial with said axis and attached to said frame member guiding said tool head, inertia member, frame member and handle for relative angular motion about said axis, said inertia member comprising a tube having a substantially uniform wall thickness with a continuous bearing surface at each end of said tube coaxial with said axis, said bearing surface engaging a mating bearing surface attached to said frame member to form a portion of said bearing means, said tool head comprising a cylindrical portion having a series of circumferentially equally spaced elongated ratchet teeth arranged thereon parallel to said axis, and an output drive portion extending coaxially along said axis at each end of the cylindrical portion, a pawl pivotally supported at one edge in a pawl seat attached to the inner side of said tube, said pawl biased by pawl spring means for engagement of its unseated edge with said ratchet teeth and a pawl retaining member attached to said tube cooperating with the unseated edge of the pawl to hold it pivotally in said seat, cam means rigid with the frame member for disengagement of the pawl from and reengagement of it with said ratchet teeth to produce impact against the ratchet teeth and torque on said tool head and output torque on said output drive portion as said handle is moved in a predetermined direction about said axis relative to said tool head, said cam means comprising a separate cam for disengagement and reengagement of each said pawl from said ratchet teeth in such instances as there is more than one pawl supported on said inertia member, each such separate cam being attached individually to said frame member, and interacting means between said inertia member and said handle providing for holding said inertia member rotationally immobile relative to said handle about said axis when said handle is not being moved in the said predetermined direction and for stopping the rotation of the inertia member relative to said handle about said axis by absorbing kinetic energy of rotation from the inertia member not delivered therefrom to the tool head as impact, said interacting means between said inertia member and said handle including a first stop member carried by said inertia member angularly movable about said axis relative to a second stop member carried by said frame member, said first stop member and said second stop member at times coming into forcible abutment with one another following said disengagement of said pawl to stop rotation of said inertia member, and a pivotal connection between said handle and said frame member to allow limited angular movement of said handle in one direction about said pivotal connection relative to said frame member about an axis parallel to the axis of said inertia member and remote from the centerline of said handle to cause partial compression of said power spring following said abutment of said first stop member with said second stop member.

2. The tool as claimed in claim 1 in which said coupling means includes a spring stop member on said handle for limiting decompressive movement of said spring, and wherein said first stop member consists of said pawl.

3. In a manually operable torque magnifying impact tool whose impact blows are delivered from energy stored in and released from a spring, and including an inertia member surrounding a tool head on a common axis, the improvement comprising a frame member supporting said inertia member and said tool head rotatably relative to one another about said axis, an operating handle enclosing said spring and connected to said frame member for angular movement in unison therewith in either direction relative to said inertia member and said tool head about said axis, coupling means between said spring and said inertia member providing for storing and releasing energy, said tool head comprising a cylindrical portion having an axial opening therethrough with a coaxial bearing surface at each end and having a series of circumferentially equally spaced elongated ratchet teeth arranged thereon parallel to said axis, a separable output drive bar portion extending through said axial opening to a point beyond each end of said cylindrical portion, said drive bar portion and said axial opening being of such male and female mating shapes, respectively, to render said drive bar portion and said cylindrical portion fixed against rotation relative to one another about said axis, means associated with said drive bar portion to prevent movement of said bar longitudinally on said axis relative to said cylindrical portion, a cylindrical tube attached to said frame member coaxially with said axis with one end of said tube mating as a bearing with said bearing surface at the end of the said cylindrical portion of said tool head, a pawl movably supported on the inertia member and spring biased for engagement with and for disengagement from said ratchet teeth, cam means rigid with said frame member around said axis operatingly contacting said pawl to disengage it from and to reengage it with said ratchet teeth to produce impact against said ratchet teeth and torque on said tool head and said output drive bar portion as said handle is moved in a predetermined direction about said axis relative to said tool head, and interacting means between said inertia member and said handle providing for holding the inertia member rotationally immobile about said axis relative to said handle when said handle is not being moved in the said predetermined direction and for stopping the rotation of said inertia member relative to said handle about said axis by absorbing kinetic energy of rotation from said inertia member not delivered therefrom to said tool head as impact, said interacting means between said inertia member and said handle including a first stop member carried by said inertia member angularly movable about said axis relative to a second stop member carried by said frame member, said first stop member and said second stop member at times coming into forcible abutment with one another following said disengagement of said pawl to stop rotation of said inertia member, and a pivotal connection between said handle and said frame member to allow limited angular movement of said handle in one direction about said pivotal connection relative to said frame member about an axis parallel to the axis of said inertia member and remote from the centerline of said handle to cause partial compression of said power spring following said abutment of said first stop member with said second stop member.

4. The tool as claimed in claim 3 in which said coupling means includes a spring stop member on said handle for limiting decompressive movement of said spring, and wherein said first stop member consists of said pawl.

5. A manually operable torque magnifying impact tool comprising a rotary tool head, an annular inertia member around said tool head on a common axis therewith, a frame member transverse the common axis at each end of the inertia member, a torque input handle extending transversely of said axis and connected to said frame member, bearing means coaxial with said axis and attached to said frame member guiding said tool head, inertia member, frame member and handle for relative angular movement about said axis, an elongated power spring within said handle, coupling means between said inertia member and said power spring for storing and releasing energy, said tool head including a cylindrical portion having a series of circumferentially equally spaced elongated ratchet teeth around its cylindrical surface parallel to said axis, a pawl pivotally supported at one edge in a seat on said inertia member, said pawl biased by pawl spring means for engagement of its unseated edge with said ratchet teeth, cam means rigid with said frame member around said axis operatingly contacting said pawl for its disengagement from and reengagement with said ratchet teeth to impart torque-producing impact to said tool head as said handle is moved angularly in a predetermined direction about said axis relative to said tool head, and interacting means between said inertia member and said handle providing for holding said inertia member rotationally immobile about said axis relative to said torque input handle when said handle is not being moved in said predetermined direction and for stopping the rotation of said inertia member by partial compression of said power spring to absorb kinetic energy of rotation from said inertia member not delivered therefrom to said tool head as torque-producing impact, said interacting means between said inertia member and said handle including a first stop member carried by said inertia member angularly movable about said axis relative to a second stop member carried by said frame member, said first stop member and said second stop member at times coming into forcible abutment with one another following said disengagement of said pawl to stop rotation of said inertia member, and a pivotal connection between said handle and said frame member to allow limited angular movement of said handle in one direction about said pivotal connection relative to said frame member about an axis parallel to the axis of said inertia member and remote from the centerline of said handle to cause partial compression of said power spring following said abutment of said first stop member with said second stop member.

6. The tool as claimed in claim 5 in which said coupling means includes a spring stop member on said handle for limiting decompressive movement of said spring, and wherein said first stop member consists of said pawl.

7. A manually operable torque magnifying impact tool comprising a rotary tool head, an annular inertia member around the tool head on a common axis therewith, a frame member transverse the common axis at each end of said inertia member, a torque input handle extending transversely of said axis and connected to said frame member, bearing means coaxial with said axis and attached to said frame member guiding said tool head, inertia member, frame member and handle for relative angular movement about said axis, an elongated power spring within said handle, coupling means between said power spring and said inertia member for storing and releasing energy, said tool head including a cylindrical portion having a series of circumferentially equally spaced elongated ratchet teeth around its cylindrical surface parallel to said axis, a pawl pivotally supported at one end in a seat on said inertia member, said pawl biased by pawl spring means for engagement of its unseated end with said ratchet teeth, cam means rigid with the frame member around said axis operatingly contacting said pawl for its disengagement from and reengagement with the said ratchet teeth to impart torque-producing impact to said tool head as said handle is moved angularly in a predetermined direction about said axis relative to said tool head, said coupling means including a spring stop member on said handle for limiting decompressive movement of said spring, and interacting means between said inertia member and said handle including a first stop member on said inertia member and a second stop member on said frame member for holding said inertia member rotationally immobile about said axis relative to said torque-input handle when said handle is not being moved in said predetermined direction and for stopping the rotation of said inertia member by engagement of said first stop member with said second stop member, said first stop member consisting of said pawl.

8. A manually operable torque magnifying impact tool comprising a rotary tool head, an annular inertia member around the tool head on a common axis therewith, a frame member transverse to the common axis at each end of said inertia member, a torque input handle extending transversely of said axis and connected to said frame member, an elongated power spring within said handle, coupling means between said power spring and said inertia member providing for storing and releasing energy, bearing means coaxial with said axis and attached to said frame member guiding said tool head, inertia member, frame member and handle for relative angular motion about said axis, said inertia member comprising a tube having a substantially uniform wall thickness with a continuous bearing surface at each end of said tube coaxial with said axis, said bearing surface engaging a mating bearing surface attached to said frame member to form a portion of said bearing means, said tool head comprising a clyindrical portion having a series of circumferentially equally spaced elongated ratchet teeth arranged thereon parallel to said axis, and an output drive portion extending coaxially along said axis at each end of the cylindrical portion, a pawl pivotally supported at one edge in a pawl seat attached to the inner side of said tube, said pawl biased by pawl spring means for engagement of its unseated edge with said ratchet teeth and a pawl retaining member attached to said tube cooperating with the unseated edge of the pawl to hold it pivotally in said seat, cam means rigid with the frame member for disengagement of the pawl from and reengagement of it with said ratchet teeth to produce impact against the ratchet teeth and torque on said tool head and output torque on said output drive portion as said handle is moved in a predetermined direction about said axis relative to said tool head, said cam means comprising a separate cam for disengagement and reengagement of each said pawl from said ratchet teeth in such instances as there is more than one pawl supported on said inertia member, each such separate cam being attached individually to said frame member, and interacting means between said inertia member and said handle providing for holding said inertia member rotationally immobile relative to said handle about said axis when said handle is not being moved in the said predetermined direction and for stopping the rotation of the inertia member relative to said handle about said axis by absorbing kinetic energy of rotation from the inertia member not delivered therefrom to the tool head as impact, the combination of said coupling means and said interacting means including an inertia member cam attached to and extending circumferentially partially around and radially outward from the peripheral surface of said inertia member, said inertia member cam including a power portion and a recoil portion with a detent portion therebetween, a cam follower roller carried by a support member movably supported on said frame member and in operational contact with said spring, said roller being seated in said detent portion by force of said spring on said support member to hold said inertia member, roller, support member, frame member, and handle rotationally immobile relative to one another about said axis when said handle is not being moved in said predetermined direction, said roller operationally interacting with said power portion to compress said spring to store energy when said handle is moved in said predetermined direction about said axis relative to said inertia member and to decompress said spring and release said energy to said inertia member following disengagement of said pawl, and said roller operationally interacting with said recoil portion following said disengagement to compress said spring and absorb kinetic energy of rotation from said inertia member not delivered to said tool head.

9. In a manually operable torque magnifying impact tool whose impact blows are delivered from energy stored in and released from a spring, and including an inertia member surrounding a tool head on a common axis, the improvement comprising a frame member supporting said inertia member and said tool head rotatably relative to one another about said axis, an operating handle enclosing said spring and connected to said frame member for angular movement in unison therewith in either direction relative to said inertia member and said tool head about said axis, coupling means between said spring and said inertia member providing for storing and releasing energy, said tool head comprising a cylindrical portion having an axial opening therethrough with a coaxial bearing surface at each end and having a series of circumferentially equally spaced elongated ratchet teeth arranged thereon parallel to said axis, a separable output drive bar portion extending through said axial opening to a point beyond each end of said cylindrical portion, said drive bar portion and said axial opening being of such male and female mating shapes, respectively, to render said drive bar portion and said cylindrical portion fixed against rotation relative to one another about said axis, means associated with said drive bar portion to prevent movement of said bar longitudinally on said axis relative to said cylindrical portion, a cylindrical tube attached to said frame member coaxially with said axis with one end of said tube mating as a bearing with said bearing surface at the end of the said cylindrical portion of said tool head, a pawl movably supported on the inertia member and spring biased for engagement with and for disengagement from said ratchet teeth, cam means rigid with said frame member around said axis operatingly contacting said pawl to disengage it from and to reengage it with said ratchet teeth to produce impact against said ratchet teeth and torque on said tool head and said output drive bar portion as said handle is moved in a predetermined direction about said axis relative to said tool head, and interacting means between said inertia member and said handle providing for holding the inertia member rotationally immobile about said axis relative to said handle when said handle is not being moved in the said predetermined direction and for stopping the rotation of said inertia member relative to said handle about said axis by absorbing kinetic energy of rotation from said inertia member not delivered therefrom to said tool head as impact, the combination of said coupling means and said interacting means including an inertia member cam attached to and extending circumferentially partially around and radially outward from the peripheral surface of the said inertia member, said inertia member cam including a power portion and a recoil portion with a detent portion therebetween, a cam follower roller carried by a support member movably supported on said frame member and in operational contact with said spring, said roller being seated in said detent portion by force of said spring on said support member to hold said inertia member, roller, support member, frame member, and handle rotationally immobile relative to one another about said axis when said handle is not being moved in said predetermined direction, said roller operationally interacting with said power portion to compress said spring to store energy when said handle is moved in said predetermined direction about said axis relative to said inertia member and to decompress said spring and release said energy to said inertia member following disengagement of said pawl, and said roller operationally interacting with said recoil portion following said disengagement to compress said spring and absorb kinetic energy of rotation from said inertia member not delivered to said tool head.

10. A manually operable torque magnifying impact tool comprising a rotary tool head, an annular inertia member around said tool head on a common axis therewith, a frame member transverse the common axis at each end of the inertia member, a torque input handle extending transversely of said axis and connected to said frame member, bearing means coaxial with said axis and attached to said frame member guiding said tool head, inertia member, frame member and handle for relative angular movement about said axis, an elongated power spring within said handle, coupling means between said inertia member and said power spring for storing and releasing energy, said tool head including a cylindrical portion having a series of circumferentially equally spaced elongated ratchet teeth around its cylindrical surface parallel to said axis, a pawl pivotally supported at one edge in a seat on said inertia member, said pawl biased by pawl spring means for engagement of its unseated edge with said ratchet teeth, cam means rigid with said frame member around said axis operatingly contacting said pawl for its disengagement from and reengagement with said ratchet teeth to impart torque-producing impact to said tool head as said handle is moved angularly in a predetermined direction about said axis relative to said tool head, and interacting means between said inertia member and said handle providing for holding said inertia member rotationally immobile about said axis relative to said torque input handle when said handle is not being moved in said predetermined direction and for stopping the rotation of said inertia member by partial compression of said power spring to absorb kinetic energy of rotation from said inertia member not delivered therefrom to said tool head as torque-producing impact, the combination of said coupling means and said interacting means including an inertia member cam attached to and extending circumferentially partially around and radially outward from the peripheral surface of the said inertia member, said inertia member cam including a power portion and a recoil portion with a detent portion therebetween, a cam follower roller carried by a support member movably supported on said frame member and in operational contact with said spring, said roller being seated in said detent portion by force of said spring on said support member to hold said inertia member, roller, support member, frame member, and handle rotationally immobile relative to one another about said axis when said handle is not being moved in said predetermined direction, said roller operationally interacting with said power portion to compress said spring to store energy when said handle is moved in said predetermined direction about said axis relative to said inertia member and to decompress said spring and release said energy to said inertia member following disengagement of said pawl, and said roller operationally interacting with said recoil portion following said disengagement to compress said spring and absorb kinetic energy of rotation from said inertia member not delivered to said tool head.

* * * * *